United States Patent [19]

Bystedt

[11] 4,017,356

[45] Apr. 12, 1977

[54] APPARATUS AND METHOD FOR MANUFACTURING WOOD PULP BY GRINDING WOOD BLOCK MATERIAL

[75] Inventor: Hjalmar Sten Ingemar Bystedt, Danderyd, Sweden

[73] Assignee: Defibrator AB, Stockholm, Sweden

[22] Filed: Mar. 22, 1976

[21] Appl. No.: 669,308

Related U.S. Application Data

[63] Continuation-in-part of Ser. No. 470,782, May 17, 1974, abandoned.

[30] Foreign Application Priority Data

May 22, 1973 Sweden ..... 072100/73

[52] U.S. Cl. ..... 162/26; 162/27; 162/261; 241/15; 241/28; 241/43; 241/62; 241/280; 241/296

[51] Int. Cl.[2] ..... B02C 23/18; B02C 7/12; D21B 1/16; D21B 1/26

[58] Field of Search ..... 241/15, 38, 43, 62, 241/28, 261.3, 280, 281, 282, 296, 298; 51/125, 128, 134, 215 HM; 162/24, 25, 26, 27, 261

[56] References Cited

UNITED STATES PATENTS

| | | | |
|---|---|---|---|
| 252,983 | 1/1882 | Werner | 241/28 |
| 367,504 | 8/1887 | Curtis | 241/151 |
| 1,987,946 | 1/1935 | Shaw et al. | 241/151 X |
| 2,651,976 | 9/1953 | Sutherland | 241/296 |
| 2,778,282 | 1/1957 | Sutherland | 241/296 X |
| 2,796,094 | 6/1957 | Himmelheber et al. | 241/281 X |
| 3,125,306 | 3/1964 | Kollberg et al. | 241/298 |
| 3,459,379 | 8/1969 | Brown | 241/38 |
| 3,815,834 | 6/1974 | Gilbert | 241/28 |

*Primary Examiner*—S. Leon Bashore
*Assistant Examiner*—Richard V. Fisher
*Attorney, Agent, or Firm*—Eric Y. Munson

[57] ABSTRACT

An improved apparatus and method for manufacturing ground wood pulp from ligno-cellulose containing wood block material by forcing the block material to be ground against the end surface of a rotatably mounted grinding disc which has projecting grinding means in the shape of elevations or ridges located on the disc end surface which define grooves directed towards the end surface circumference. The apparatus includes a pressure plate for pressing the block material along a longitudinal side against the disc end surface with the fibers directed outwardly from the center of the grinding disc and toward the periphery of circumference of the disc while the fibers are separated. In this manner the fibers are oriented in the same direction as the edges of the elevations or ridges which carry the fibers radially outward and the elevation edges engage the block fibers under a movement component which is transverse to the longitudinal direction of the fibers. The elevations may be straight or radial ridges or bars arranged along the radii of the end surface. Increased fiber releasing capacity and delivery of pulp of greater uniformity and improved quality can be obtained by this apparatus.

7 Claims, 4 Drawing Figures

16
15
17
21
19
22
20
14
35
36
32
26
33
30
31
34
35
12
18
13
26
II
43
12
11
II
7
25
23
22
10
6
3
47
2
1
4
5

APPARATUS AND METHOD FOR MANUFACTURING WOOD PULP BY GRINDING WOOD BLOCK MATERIAL

This application is a continuation-in-part of my copending application Ser. No. 470,782 filed May 17, 1974, now abandoned.

BACKGROUND OF THE INVENTION

1. Field of The Invention

This invention relates to an apparatus and method for manufacturing wood pulp.

More particularly, this invention relates to an apparatus and method for manufacturing ground wood pulp from ligno-cellulose containing material of the type including a grinding disc mounted rotatably about a shaft centered on both end surfaces of the grinding disc, retaining means adapted to retain and force at least one piece of material to be ground against at least one of the end surfaces and means to supply an aqueous liquid to the material. Each piece of material is forced against the grinding end surface with the fibers of the material substantially directed in the plane of the grinding surface.

2. Description of The Prior Art

The conventional method for defibrating ligno-cellulose containing material by grinding involves pressing the material, normally pieces of timber, against the cylindrical surface of a grindstone or grinding disc. This method, invented over a hundred years ago, still dominates the production of mechanical paper pulp.

Despite many attempts at improvements of this method during the course of years, the method nevertheless has its decided limitations. Currently, the grinding surface often consists of sharp grains of ceramic material embedded in a binder. When the grains are worn, the surface of the disc becomes smooth and production is reduced while at the same time the pulp is ground too finely. The grinding disc must then be redressed by means of a sharpening roller, which pulls up a new grinding pattern. Because this results in the working surface of the disc being changed continuously during the grinding operation, the quality of the pulp cannot be maintained uniform. In addition, the grinding grains tear off many of the fibers resulting in a short-fiber pulp with poor strength qualities. By the redressing operation grains are torn from the disc and admixed to the pulp, causing wear in the machines used for subsequent treatment of the pulp.

Although attempts have been made to replace the cylindrical working surface by a patterned steel surface, no practical success has been obtained for several reasons, among which the difficulty of producing a curved steel grinding surface at a reasonable cost is the most prominent one.

More recently, it has been proposed to provide the cylindrical grinding surface with ribs, bars or similar straight projections made of steel, a metal alloy or other suitable hard material, the upper cutting portions of which have been made arcuate with certain definite heights and arc radii. While a good final product is obtained by the use of such a grinding disc, the grinding means are very expensive. Thus, such discs must be made with very fine tolerances and must be replaced rather often because they wear like all grinding appliances and in this way relatively soon completely lose their good grinding qualities.

A feature common to all the grinding discs of the kinds referred to hereinbefore is that the removal capacity of the disc can only be increased to a certain limit which is determined by the length of the grinding disc, its diameter and its rotational speed. This limit has already been reached a long time ago in modern grinding plants. When attempting to further increase the diameter of the grinding disc or its length, the bending moment acting on the horizontal shaft carrying the disc will exceed tolerable limits, and the distance between the bearings will be increased to a corresponding practically intolerable extent. At high rotational speed the stresses on the grinding disc will be large and the grinding rendered more difficult by the wood material being thrown out from the grinding surface by centrifugal force, a serious disadvantage.

Modern grinders with automatic replenishment of material such as blocks, short logs or lumps of timber, in contrast to chips which are treated in disc refiners, usually have two compartments for the pieces of wood and thus two subsequent grinding areas on the cylindrical surface of the grinding disc. The compartments are filled batch-wise. When one compartment is being filled, the effective grinding surface is reduced to one half, which causes a corresponding reduction in the load on the driving electrical motor and thereby disturbances in the electrical power supply. Moreover, the grinding disc is loaded unevenly and the shaft bearings are therefore exposed to unduly large stresses. Since the disc rotates about a horizontal axis and since the cylindrical surface forms the grinding surface, it is obvious that it is not possible to distribute a greater number of compartments over the grinding surface.

All the aforementioned difficulties together have caused complete stagnation in the further development of wood pulp grinding machines of the general type described, and the abovestated disadvantages have been accepted in the art as unavoidable.

SUMMARY OF THE INVENTION

The foregoing disadvantages are overcome according to this invention through the provision of an improved apparatus and method for manufacturing ground wood pulp from ligno-cellulose containing wood block material by forcing the block material to be ground against the end surface of a rotatably mounted grinding disc having projecting grinding means in the shape of elevations or ridges located on the disc end surface which define grooves directed towards the end surface circumference. The apparatus includes retaining means for pressing the block material along a longitudinal side against the disc end surface with the fibers directed outwardly from the center of the grinding disc and toward the periphery or circumference of the disc while the fibers are separated. In this manner the fibers are oriented in the same direction as the edges of the elevations or ridges which carry the fibers radially outward and the elevation edges engage the block fibers under a movement component which is transverse to the longitudinal direction of the fibers. The elevations may be straight or radial ridges or bars arranged along the radii of the end surface. Increased fiber releasing capacity and delivery of pulp of greater uniformity and improved quality can be obtained by this apparatus.

Accordingly, an object of the invention is the provision of a wood pulp manufacturing method and apparatus the grinding disc of which possesses a substantially increased fiber releasing capacity.

Another object of the invention is the provision of a wood pulp manufacturing method and apparatus of the grinding disc type which is capable of delivering pulp of uniform and improved quality.

Still another object of the invention is the provision of a wood pulp manufacturing method and apparatus wherein the forces of unbalance are considerably reduced when compared with the known constructions.

According to one embodiment of the invention the grinding end surface is provided with projecting grinding means in the shape of straight elevations having edges and defining between themselves grooves directed towards the periphery or circumference of the end surface, the retaining means is adapted to retain each piece of material and provided with means for pressing block material pieces along a longitudinal side against the disc end surface with their fibers directed outwardly essentially radially from the center of the grinding disc and the liquid supply means is disposed to feed the liquid to the center of the grinding disc.

In the operation of this embodiment, the loosened fibers will not be thrown off from the grinding disc as soon as they have come clear from the piece of wood from which they have been torn off, as in conventional grinders, but will be carried radially outwards on the end surface toward the disc periphery to several times pass the batch of wood lumps under grinding treatment and thus be processed further. Thus, the fibers are separated to orient the fibers in the same direction as the edges of the elevation. While the fibers are carried radially outward, the elevation edges engage the block fibers and a movement component transverse to the longitudinal direction of the fibers. In addition, larger torn-off fibers farthest out at the circumference of the disc can be more easily prevented from leaving the grinding surface before they are processed to a definite minimum size, which assists in imparting a very good quality to the final pulp product.

Since the grinding surface is formed by one end surface of the disc, a large number of compartments can be distributed over the surface of the disc. An even distribution of the compartments also means that only one compartment at a time will be inactive during refilling of the apparatus whereas changes in load as well as the unbalance forces are reduced to a tolerable level.

Further objects, features and advantages of the invention will become apparent from the following description, considered in connection with the accompanying drawings, which form part of this specification and in which:

DESCRIPTION OF THE PREFERRED EMBODIMENT

Figure 1:
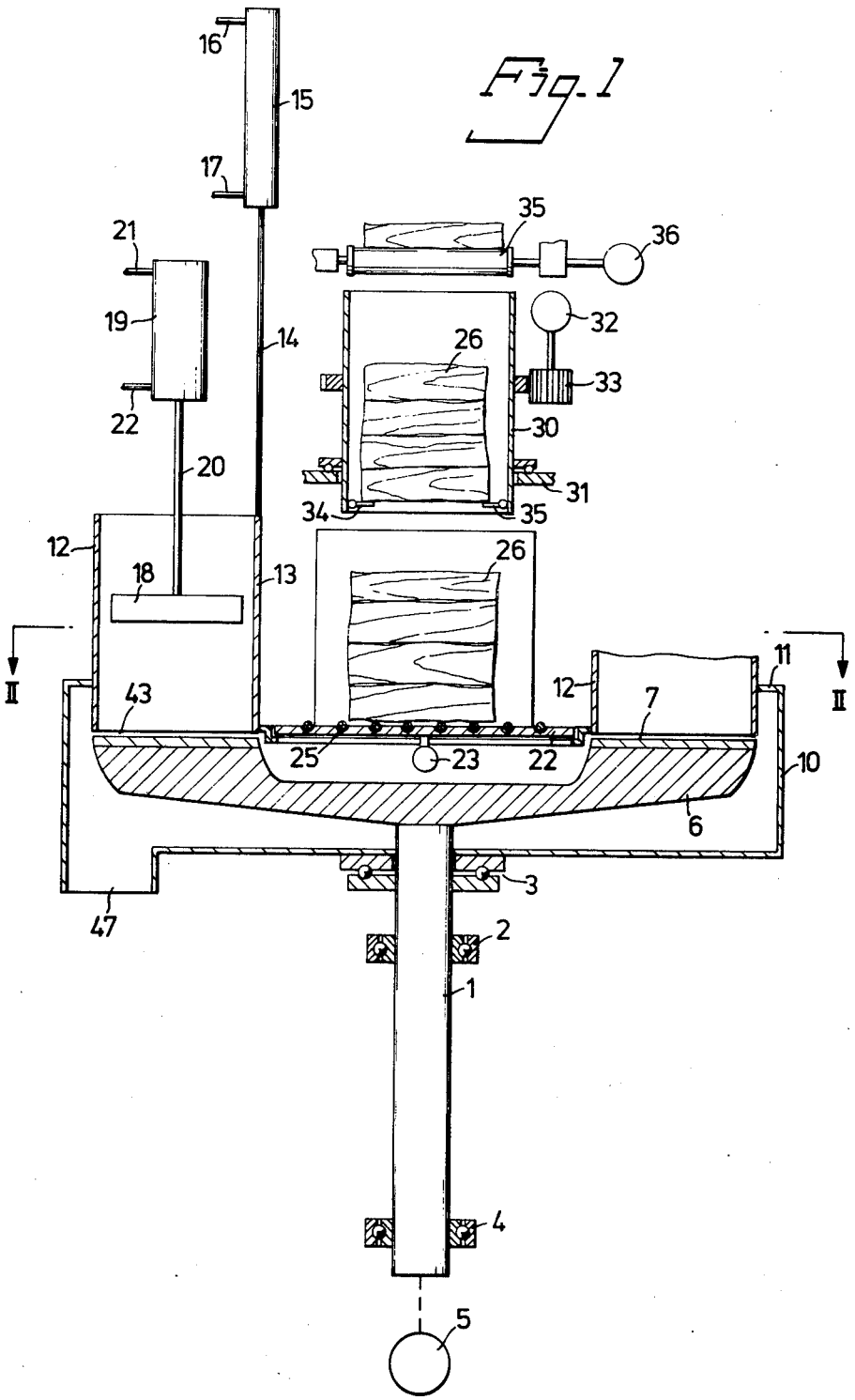
FIG. 1 is a simplified elevational view, partly in section, of the essential parts of a grinding apparatus constructed according to an embodiment of the invention.
Figure 2:
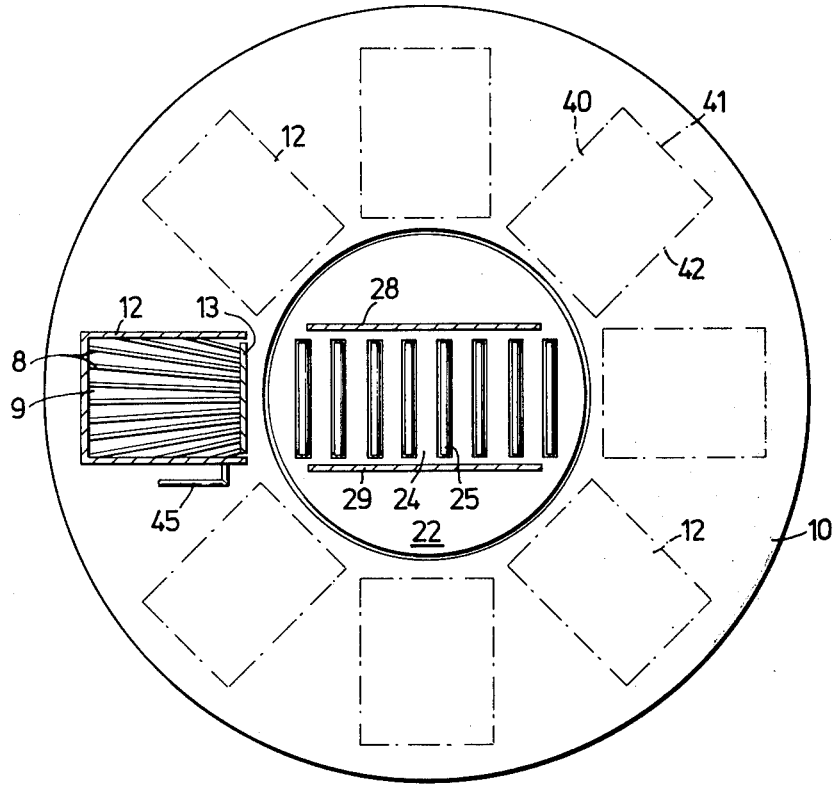
FIG. 2 is a top view, partly in section, taken on the line II—II of FIG. 1.
Figure 4:
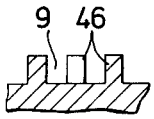
FIG. 4 is a view, in section, taken on the line IV—IV of FIG. 3.

Referring to the drawings and in particular to FIGS. 1 and 2, the illustrated grinding apparatus has a vertical shaft 1, which is mounted rotatably in an upper radial bearing 2, an axial bearing 3 and a lower radial bearing 4. The shaft is driven by an electric motor 5. Shaft 1 carries a horizontal circular grinding disc 6 made of steel or any other suitable material and having an annular grinding surface 7. As shown in FIG. 2 the surface 7 has radial straight elevations or ridges 8 extending from the interior of the grinding surface to the periphery or circumference thereof. Between themselves the ridges 8 define grooves 9.

The grinding disc 6 is surrounded by a rigid housing 10, forming a portion of the supporting structure (not shown) of the apparatus. Housing 10 has an upper annular plate 11 on which are provided compartments 12 for the pieces of wood which are to be ground to pulp. Each compartment 12 comprises a box with a completely open bottom, the pieces of wood introduced into the respective compartments thus resting against the underlying grinding surface 7. The illustrated embodiment has eight compartments 12 evenly distributed around the grinding surface.

Each compartment 12 has a hatch 13 facing the interior of the grinding disc, which hatch is attached to a doubleacting cylinder 15 by a piston rod 14. The cylinder 15 is connected to pipes 16 and 17 for an operating medium delivered from a source not shown. Hatch 13 is mounted on guides on the box walls in a manner not more closely illustrated, and can be displaced by cylinder 15 to a lower closed position shown in the drawing, or to an upper position in which the respective compartment is completely open to the inner portion of the grinding disc.

Arranged in each compartment 12 is a pressure plate 18 which is operated by a cylinder 19 via a piston rod 20. Cylinder 19 has pipes 21 and 22 for an operating medium from a source not shown.

Housing 10 carries a turntable 22 coaxial with shaft 1, the turntable being mounted rotatably and connected to a reversible driving electric motor 23. The turntable 22 is equipped with a conveyer 24 having rollers 25, driven in either direction by driving means not shown, for conveying one or more pieces of wood 26 to the compartment 12 which is to be filled. On either side of conveyer 24, vertical walls 28, 29 rigidly attached to the turntable 22, form supporting walls for the piece or pieces of wood on conveyer 24.

Overhead of the conveyer 24, a rotatable magazine 30 is disposed coaxially with shaft 1. The magazine 30 is mounted rotatably in a fixed frame portion 31 and is turned by a reversible motor 32 via suitable transmission 33. The bottom of the magazine is open towards the conveyer 24, but provided with pivotable flaps 34 and 35, against the ends of which bear the pieces of wood 26 fed into the magazine 30. The flaps 34, 35 are pivotable downwardly by means of a mechanism not shown here, causing the pieces of wood in the magazine to fall onto the conveyer 24.

Fixed above the magazine 30 is a conveyer 35, e.g., a belt conveyer, driven by a motor 36 for feeding definite batches of wood to the magazine 30, after this latter has been emptied and by the motor 32 turned into the receiving position.

The three side walls 40, 41, 42 (FIG. 2) in each compartment are either as a unit or individually vertically displaceable relative to the grinding surface 7 so as to render it possible to adjust the exit gap 43 (FIG. 1) between the grinding surface 7 and the lower edges of the compartment extending in parallel to the grinding surface in relation to wear of the grinding surface and also to desired processing of the layer of pulp formed on the grinding surface, as this layer is moved radially outwards as mentioned hereinbefore. The liquid, which may be water or a treating chemical solution is supplied to the inner portion of the grinding surface adjacent shaft 1 through pipes 45 (FIG. 2) opening into one or more nozzles in each compartment 12.

The ridges 8 and grooves 9 shown in FIG. 2 are suitably formed on separate circular segments, made of steel, a metal alloy or similar hard material, which are attached to the disc 6. Such segments are easily exchangeable and are easy to manufacture.

Figure 3:
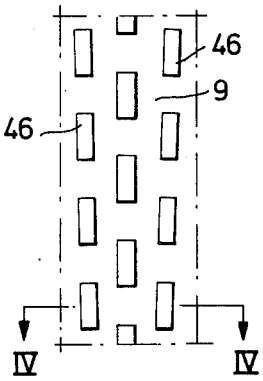
FIG. 3 is a top face view of a portion of a grinding surface according to another embodiment of the invention.

FIG. 3 shows a portion of the grinding surface of the disc with the continuous ridges replaced by bars 46, located several of them with interspaces along individual radii and forming grooves 9 between adjacent groups. The pulp is moved radially outwards by centrifugal force along grooves 9 through gaps 43 into the housing 10, from which the finally ground pulp is discharged through outlet 47.

In operation of the above described apparatus, a batch of pieces of wood 26 is fed by the conveyer 35 to the magazine 30. The magazine 30 is then turned into the position in which communication can be established with conveyer 24, whereafter the flaps 34 and 35 are turned down. The batch of wood then falls down onto the conveyer 24. The conveyor 24 is assumed to take the position shown in FIG. 2, and is started after that the hatch 13 has been lifted and thereby entrance to the left-hand compartment 12 has been opened. The batch is conveyed into the compartment, the conveyer 24 is stopped and the hatch 13 pushed downwards again. Meanwhile, the magazine 30 has received a new batch, and this batch is not transferred onto conveyer 24 which is started in the opposite direction and conveys the batch to the right-hand compartment 12 located diametrically opposite the compartment first filled. In the embodiment illustrated in FIGS. 1 and 2 conveyer 24 thereafter is turned 45° and the magazine is turned to the same position for transfer of a new batch. The cycle is repeated until all these compartments have been filled. Since loading of the compartments 12 has been made while the grinding disc 16 is rotating, the batch in the compartment that has been filled first has either been consumed completely or at least partly and is replaced first of all. Since only one compartment is filled at a time, only one eighth of the active grinding surface is relieved at a time in the illustrated embodiment. The bending moment on the shaft and therefor the reduction of the load on the driving motor 5 will be insignificant.

The pressure applied by the respective pressure plate 18 on each batch is adjustable to render possible adjustment of the quality of pulp and the production capacity, which latter can be varied within wide limits depending on the disc diameter and rotational speed, which may be considerably greater than in conventional grinders.

The liquid supplied to the center of the grinding disc may be water, as mentioned earlier. Preferably, this water has a temperature of about between 40° and 90° C. Process return water which has been returned from de-watering the pulp after dilution and filtering may be utilized for this purpose. Due to frictional heat the temperature in the grinding areas increases rapidly to about 100° C. The lignine between the fibers is softened thereby and the fibers are more easily separated with less damage to them. An aqueous solution of chemicals may also be used for the purpose of controlling the pH of the pulp suspension, improving the bleaching effect and facilitating fiber separation by actuation on the lignine. Though the preferred direction of the fibers in the pieces of wood is radial the fibers may form a more or less greater angle to the radii of the grinding disc.

As can be seen in FIG. 1, an oblong block of wood 26 is placed in the magazine 30 so that its longitudinal direction, and consequently the fibers, extends parallel with the radially extending elevations or ridges 8 (FIG. 2) and the fibers are directed outwardly from the center of the grinding disc 6 to the periphery of the disc while the fibers are separated. In this manner the fibers are oriented in the same direction as the edges of the elevations or ridges which carry the fibers radially outward and the elevation edges engage the block fibers under a movement component which is transverse to the longitudinal direction of the fibers.

The embodiment of the invention described hereinbefore may be modified in different respects without departing from the scope of the invention. The specific devices for feeding one or more pieces of wood to the compartments could be replaced by highly different but equally suitable devices. The compartments need not be fed through an opening facing the center of the grinding disc, but could as well be fed through an opening in the outer wall or from above. Although the grinding operation has been described as being effected on an upper horizontal surface of the grinding disc, it could as well be effected against the lower horizontal surface or against both surfaces of the disc. Even though the described embodiment with a vertical axis of rotation is preferred, it is possible to have a sloping or horizontal rotating axis in the apparatus, and as in this latter case the end surfaces of the grinding disc are in a vertical plane, the pieces of wood are moved horizontally towards the end surfaces. In addition, suitable devices may be provided for cooperation with the feeding table by positively pushing the batch into each compartment when this is being filled.

I claim:

1. In an apparatus for manufacturing ground wood pulp from ligno-cellulose containing block material by separating the fibers therein, including a grinding disc mounted rotatably about a shaft coaxial with both end surfaces of said grinding disc, retaining means to force at least one piece of the block material to be ground against at least one of said end surfaces, means to supply an aqueous liquid to the material, each piece of material being forced against at least the one disc end surface forming a grinding surface with the fibers of the material substantially directed in the plane of the grinding surface, the improvement enabling increased fiber releasing capacity and delivery of pulp of greater uniformity and improved quality comprising, projecting grinding means in the shape of elevations located on at least the one disc end surface, the elevations defining between themselves grooves directed towards the periphery of the end surface, the retaining means being adapted to force each piece of block material along a longitudinal side against at least the one end surface with its fibers directed outwardly from the center of the grinding disc toward the disc periphery while the fibers are separated to orient the fibers in the same direction as the edges of the elevations and carry the fibers radially outward and the elevation edges engage the block fibers under a movement component transverse to the longitudinal direction of the fibers.

2. The apparatus as claimed in claim 1 wherein the retaining means comprises at least one compartment, stationary relative to the grinding disc, and a feeding table means located within the central portion of the grinding disc for feeding at least one piece of material by moving it in the direction of its fibers into the compartment.

3. The apparatus as claimed in claim 1 wherein the grinding means elevations comprise straight ridges.

4. The apparatus as claimed in claim 3 wherein the elevations extend essentially radially.

5. The apparatus as claimed in claim 1 wherein the grinding means elevations comprise bars, arranged along radii on at least the one end surface.

6. A method for manufacturing ground wood pulp from ligno-cellulose containing block material by separating the fibers therein by grinding the block material against a rotating grinding disc end surface comprising providing projecting means in the shape of elevations on the disc end surface to define grooves directed toward the end surface periphery, pressing each piece of block material along a longitudinal side against the disc end surface with its fibers directed outwardly from the center of the grinding disc toward the disc periphery while the fibers are separated to orient the fibers in the same direction as the edges of the elevations and carrying the fibers radially outward so that the elevation edges engage the block fibers under a movement component transverse to the longitudinal direction of the fibers.

7. The method as claimed in claim 6 wherein aqueous liquid is fed to the material being ground and the liquid contains treating chemicals.

* * * * *